US006171267B1

(12) United States Patent
Baldwin, II

(10) Patent No.: US 6,171,267 B1
(45) Date of Patent: Jan. 9, 2001

(54) HIGH IMPULSE CARDIOPULMONARY RESUSCITATOR

(75) Inventor: R. Mitchell Baldwin, II, Grand Rapids, MI (US)

(73) Assignee: Michigan Instruments, Inc., Grand Rapids, MI (US)

( * ) Notice: Under 35 U.S.C. 154(b), the term of this patent shall be extended for 0 days.

(21) Appl. No.: 09/226,894

(22) Filed: Jan. 7, 1999

(51) Int. Cl.[7] ..... A61H 31/00

(52) U.S. Cl. ..... 601/106; 601/44; 601/107

(58) Field of Search ..... 601/41, 97, 105, 601/106, 107, 108, 43, 44; 128/202.16, 204.19

(56) References Cited

U.S. PATENT DOCUMENTS

| | | | | |
|---|---|---|---|---|
| 1,629,626 | | 5/1927 | Jirasek . | |
| 2,071,215 | | 2/1937 | Petersen . | |
| 3,209,748 | * | 10/1965 | Thomas | 601/105 |
| 3,277,887 | * | 10/1966 | Thomas | 601/106 |
| 3,364,924 | | 1/1968 | Barkalow . | |
| 3,364,925 | | 1/1968 | Barkalow . | |
| 3,425,409 | | 2/1969 | Isaacson et al. . | |
| 3,461,860 | | 8/1969 | Barkalow . | |
| 3,461,861 | | 8/1969 | Barkalow et al. . | |
| 3,512,522 | * | 5/1970 | Greenlee et al. | 601/106 |
| 3,610,233 | | 10/1971 | Barkalow . | |
| 3,942,513 | * | 3/1976 | Frank | 601/107 |
| 3,955,563 | * | 5/1976 | Maione | 601/107 |
| 3,985,126 | | 10/1976 | Barkalow . | |
| 4,004,579 | | 1/1977 | Dedo . | |
| 4,198,963 | | 4/1980 | Barkalow et al. . | |
| 4,273,114 | | 6/1981 | Barkalow et al. . | |
| 4,294,244 | | 10/1981 | Pasternack . | |
| 4,326,507 | | 4/1982 | Barkalow . | |
| 4,361,140 | | 11/1982 | Barkalow . | |
| 4,433,011 | * | 2/1984 | Larson et al. | 601/106 |
| 4,570,615 | | 2/1986 | Barkalow . | |
| 4,664,098 | * | 5/1987 | Woudenberg et al. | 601/107 |
| 4,676,232 | * | 6/1987 | Olsson et al. | 601/107 |

(List continued on next page.)

FOREIGN PATENT DOCUMENTS

| | | |
|---|---|---|
| 0145985 | 5/1936 | (DE) . |
| 0509773A1 | 10/1992 | (EP) . |
| 2140694A | 12/1984 | (GB) . |
| WO9426229 | 11/1994 | (WO) . |

OTHER PUBLICATIONS

Pinchak, Alfred C., Ph.D., P.E., M.D. et al., "Chest Wall Acceleration and Force Measurements in Simulated Manual and Mechanical Cardiopulmonary Resuscitation," *Critical Care Medicine*, vol. 16, No. 2, pp. 151–160, 1988.

Ornato, Joseph P., M.D., F.A.C.C. et al., "The Effect of Applied Chest Compression Force on Systemic Arterial Pressure and End–Tidal Carbon Dioxide Concentration During CPR in Human Beings," *Annals of Emergency Medicine*, pp. 732–737, Jul., 1989.

Halperin, Henry R., M.D. et al., "A Preliminary Study of Cardiopulmonary Resuscitation by Circumferential Compression of the Chest With Use of a Pneumatic Vest," *The New England Journal of Medicine*, pp. 762–768, Sep. 9, 1993.

Maier, George W., M.D. et al., "The Physiology of External Cardiac Massage: High–Impulse Cardiopulmonary Resuscitation," *Circulation*, vol. 70, No. 1, pp. 86–101, Jul., 1984.

*Primary Examiner*—Justine R. Yu
(74) *Attorney, Agent, or Firm*—Van Dyke, Gardner, Linn & Burkhart, LLP

(57) ABSTRACT

A cardiopulmonary resuscitation method and apparatus that is adapted to performing high-impulse CPR includes providing a chamber having an expandable volume and a patient-contacting pad that moves as a function of volume of the chamber and supplying a controlled quantity of a fluid to the chamber. This results in increasing the chamber volume by a controlled amount, thereby compressing the patient's chest with the patient-contacting pad during a systolic phase.

51 Claims, 13 Drawing Sheets

U.S. PATENT DOCUMENTS

| | | | | |
|---|---|---|---|---|
| 4,928,674 | | 5/1990 | Halperin et al. . | |
| 5,056,505 | | 10/1991 | Warwick et al. . | |
| 5,077,667 | | 12/1991 | Brown et al. . | |
| 5,407,421 | | 4/1995 | Goldsmith . | |
| 5,490,820 | | 2/1996 | Schock et al. . | |
| 5,571,142 | | 11/1996 | Brown et al. . | |
| 5,626,618 | | 5/1997 | Ward et al. . | |
| 5,683,424 | | 11/1997 | Brown et al. . | |
| 5,693,005 | * | 12/1997 | Vistung | 601/41 |
| 5,743,864 | | 4/1998 | Baldwin, II . | |

* cited by examiner

NO COMPRESSION

HOLD COMPRESSION

RELEASE COMPRESSION

HIGH IMPULSE CARDIOPULMONARY RESUSCITATOR

BACKGROUND OF THE INVENTION

This invention relates generally to a method and apparatus for providing automated cardiopulmonary resuscitation (CPR) in the form of closed chest cardiac compression, preferably combined with pulmonary ventilation.

A practical mechanism for automating closed chest cardiac compression was first disclosed in U.S. Pat. No. 3,364,924 assigned to my assignee, Michigan Instruments, Inc. of Grand Rapids, Mich., and has been commercially exploited under the Thumper® Cardiopulmonary Resuscitation System. The system disclosed in U.S. Pat. No. 3,461,861 added the important function of pulmonary ventilation to the Thumper® system by supplying a ventilation cycle intermittently with a number of compression cycles according to the American Heart Association protocol. The waveform of the apparatus disclosed in the '924 patent is shown at C in FIG. 14. Waveform C generally resembles a damped exponential waveform. This is an improvement over, yet similar to, the sinusoidal waveform shown at M in FIG. 14 which is produced by manual closed chest cardiac compression.

In a number of articles, including that published by Maier, George W. et al. in Circulation, Vol. 1, 1984, entitled "The Physiology of External Cardiac Massage; High-Impulse Cardio-Pulmonary Resuscitation," the disclosure of which is hereby incorporated herein by reference, a new form of CPR is proposed under the name "High Impulse CPR." In high impulse CPR, the waveform more closely resembles a square wave, or impulse, rather than a sinusoidal form. A fast rise in the chest compression stroke that increases the area under the curve, as seen in curve H in FIG. 14, applies a greater amount of energy to the patient during the systolic phase. It was discovered that the high energy supplied by the high impulse CPR waveform significantly improved perfusion in the cardiovascular system of the patient. The development of high impulse CPR resulted from studies sponsored by my assignee, Michigan Instruments, Inc.

A commercial embodiment of a high impulse CPR has remained a long felt and unmet need in the art. The exponential acceleration curve necessary to produce the high impulse CPR effect must also be combined with the necessity for controlling the length of the compression stroke. Indeed, once the massage pad, which interfaces the apparatus to the patient, is exponentially accelerated to the selected depth of compression, it must abruptly decelerate and be held at the selected depth during the systolic phase. During the diastolic, or relaxation phase, the apparatus must retract the massage pad with sufficient acceleration to allow the patient's chest to return to its non-compressed state without interference by the apparatus.

The apparatus used to carry out the initial evaluation of high impulse CPR constituted a piston and a cylinder to which a compressed gas could be rapidly supplied and a fixed mechanical stop which limited the extent of the piston travel. While such apparatus was sufficient to demonstrate the benefit of high impulse CPR, it was not commercially viable. The use of a fixed mechanical stop was noisy and made adjustment of the compression stroke rather awkward.

SUMMARY OF THE INVENTION

The present invention provides a method and apparatus for producing high impulse cardiopulmonary resuscitation (CPR) in a manner which achieves the long felt and unmet need for a commercial device of this type, particularly one that provides an adjustable depth of compression.

A method of performing cardiopulmonary resuscitation, according to an aspect of the invention, includes providing a chamber having an expandable volume and a patient-contacting pad that moves as a function of volume of the chamber and positioning the chamber with respect to the patient to bring the patient-contacting pad to alignment with the patient's chest. A controlled quantity of fluid is supplied to the chamber in order to increase the chamber volume by a controlled amount, thereby compressing the patient's chest during a systolic phase. It has been discovered that the seemingly contradictory requirements of rapidly accelerating the patient contacting pad, thereby compressing the patient's chest in a manner that achieves a controllable extent of compression depth, can be accomplished by this aspect of the invention. In particular, a very rapid acceleration of the compression stroke can be accomplished by rapidly supplying the fluid to the chamber. Control of the extent of compression depth can be achieved by controlling the quantity of the fluid supplied to the chamber.

Preferably, the chamber having an expandable volume is made up of a cylinder enclosing an adjustable piston which is connected with the patient-contacting pad, such as a rod. Most preferably, a compression spring is included in the chamber in order to rapidly return the piston to its retracted position at the beginning of the diastolic or relaxation phase. Indeed, by providing a spring of sufficient spring force, it is possible to provide a retraction force for active reshaping of the chest, as disclosed in my commonly assigned U.S. Pat. No. 5,743,864, the disclosure of which is hereby incorporated herein by reference.

According to a somewhat more detailed aspect of the invention, a cardiopulmonary resuscitation apparatus includes a chamber, a piston in the chamber, and a frame including a first portion adapted to be positioned posteriorly of a patient and a second portion supporting the chamber. The apparatus further includes a pressure source, a control valve assembly that is operative to selectively connect the pressure regulator to the chamber, and a timing circuit.

Preferably, the timing circuit selectively operates the control valve assembly to connect the pressure source to the chamber at the beginning of a systolic phase to accelerate the piston toward the patient to initiate chest compression and to disconnect the pressure source from the chamber and to seal the chamber during the remaining portion of the systolic phase. The pressure source is preferably a pressure regulator adapted to be supplied with a gas under pressure and producing a regulated pressure at an output. Also, preferably, the control valve assembly is operative to connect the pressure regulator output to the chamber. The timing circuit selectively operates the control valve assembly to supply regulated pressure from the pressure regulator output to the chamber for a controllable time period to move the piston to apply chest compression to a patient during a systolic phase.

These and other objects, advantages and features of this invention will become apparent upon review of the following specification in conjunction with the drawings.

DESCRIPTION OF THE PREFERRED EMBODIMENT

Figure 2:
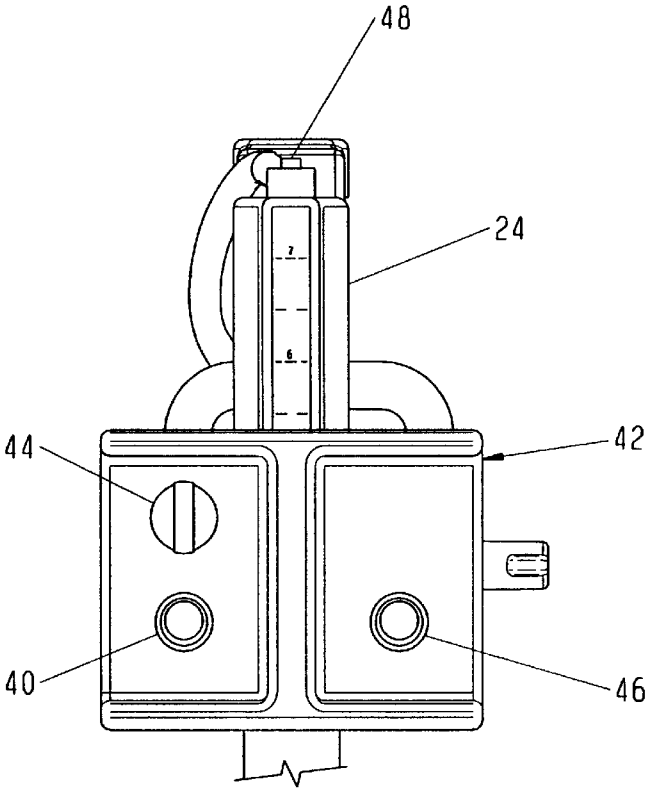
FIG. 2 is an end view taken from II—II in FIG. 1.
Figure 1:
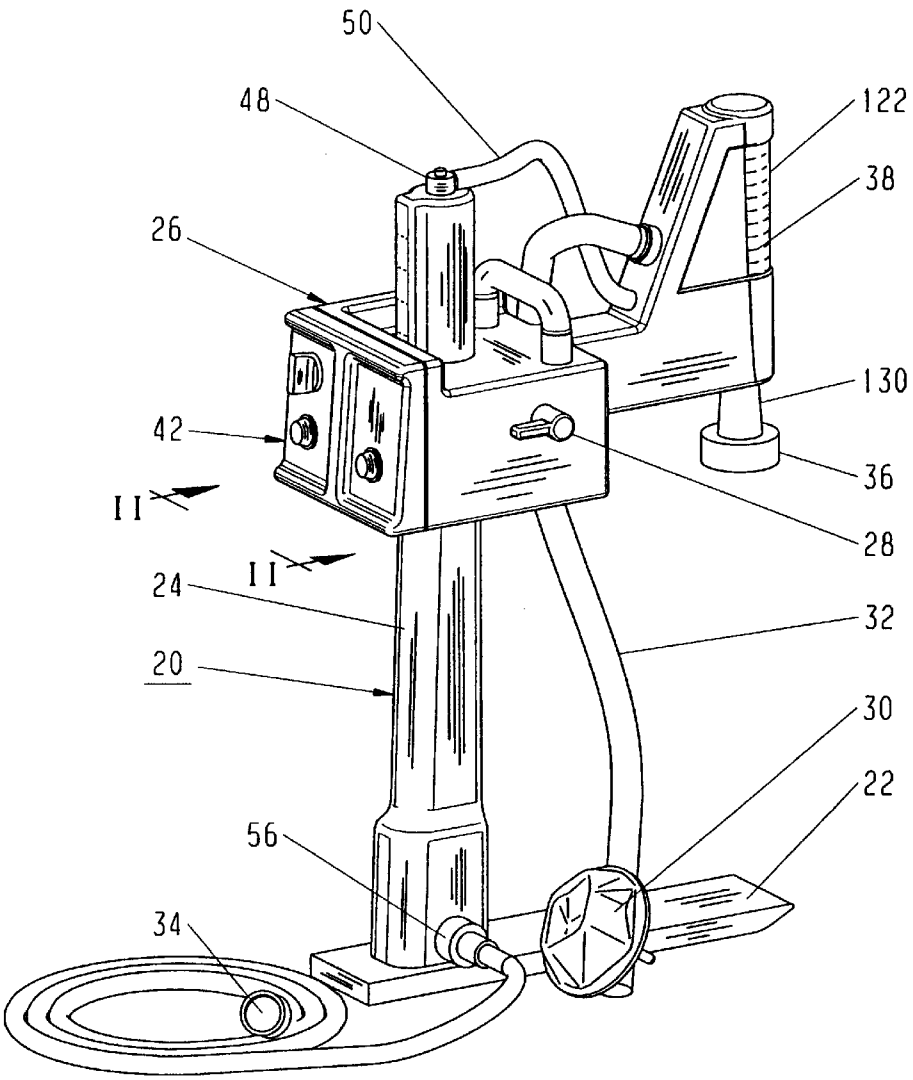
FIG. 1 is a perspective view of a cardiopulmonary resuscitation apparatus according to the invention.
Figure 3:
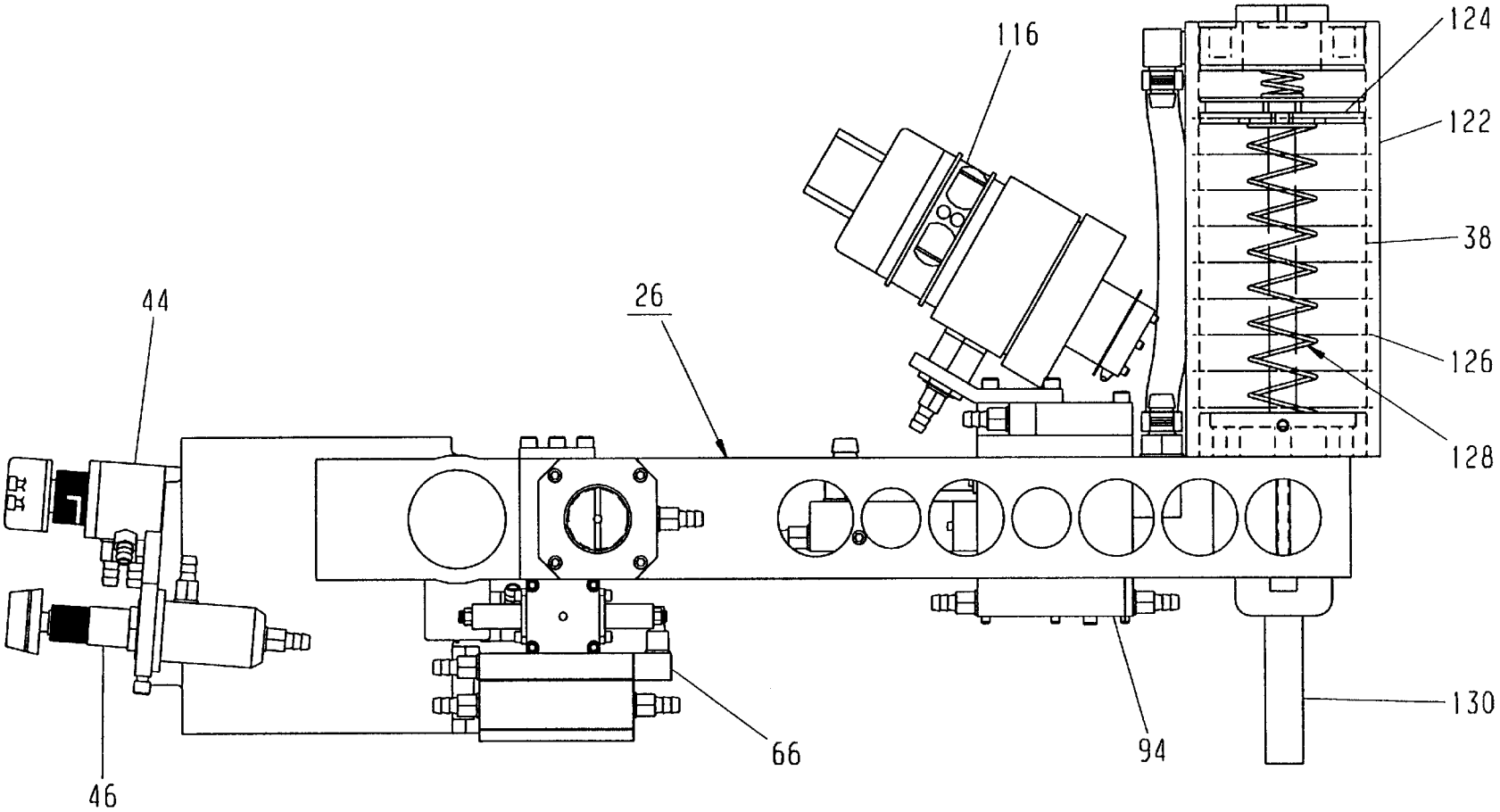
FIG. 3 is a side elevation of an arm assembly of the apparatus in FIG. 1 with the cover removed to reveal internal details thereof.
Figure 4:
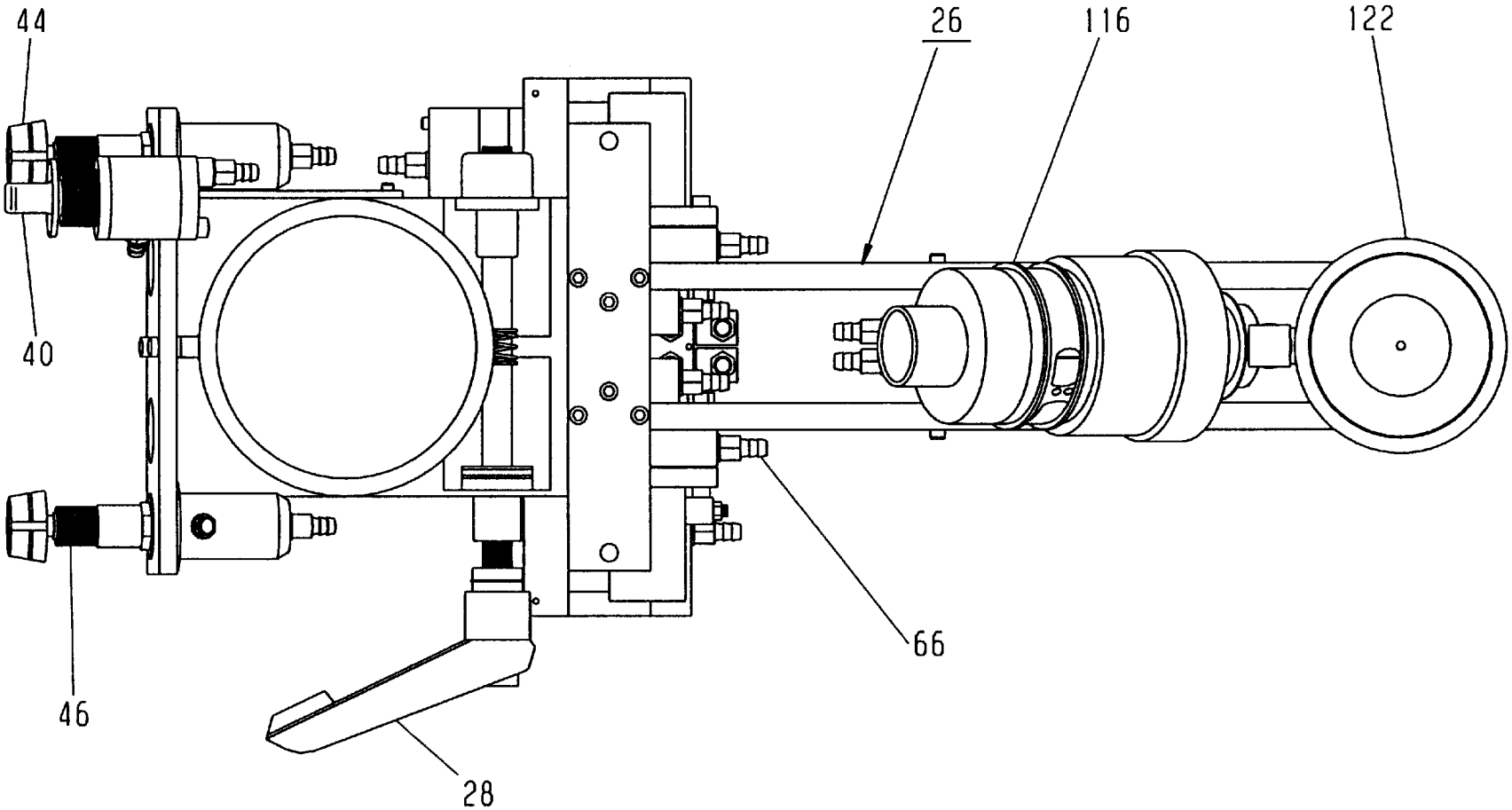
FIG. 4 is a top plan view of the arm assembly in FIG. 3.

Referring now specifically to the drawings, and the illustrative of embodiments depicted therein, a cardiopulmonary resuscitation system 20 includes a base 22, a column 24 supported by the base, and a cardiopulmonary resuscitation arm assembly 26 adjustably supported along column 24 (FIGS. 1–4). Base 22 is configured to be positioned posteriorly of the patient and may be used by itself or in combination with a patient retention and support member as disclosed in U.S. Pat. No. 3,985,126, the disclosure of which is hereby incorporated herein by reference. Column 24 supports arm assembly 26 and also provides a pneumatic buffer tank 61 for the pneumatic system and houses a system pressure regulator 62, as will be disclosed in more detail below. Arm assembly 26 is vertically adjustable along column 24 in order to accommodate the patient's chest diameter and may be adjusted by loosening a release handle 28, repositioning the arm assembly, and retightening release handle 28 at the desired position of the arm assembly. A ventilation mask 30 and hose 32 provide controlled ventilation to the patient from an oxygen canister (not shown) connected to CPR system 20 by a connection hose 34. In the illustrative embodiment, the oxygen supplied through hose 34 is also used to operate a pneumatic control system 52 which operates the closed chest compression portion of system 20. However, the closed chest compression portion of system 20 could, alternatively, be operated from a different compressed gas, such as carbon dioxide or even from a hydraulic fluid source.

CPR arm assembly 26 includes a patient interface, such as a massage pad 36, or the like, which may be of the type disclosed in commonly assigned U.S. Pat. No. 4,570,615 entitled CARDIO-PULMONARY RESUSCITATOR PAD, the disclosure of which is incorporated by reference herein. The massage pad provides a conforming interface between the CPR system and the patient's sternum. Arm assembly 26 additionally includes, a compression depth gauge 38, which provides the operator an indication of the depth of compression which is being achieved. Compression depth is controllable by a compression depth input device 40 mounted on a control panel 42. Control panel 42 additionally includes a run/stop input device 44 and a ventilation volume input device 46. CPR system 20 additionally includes a pressure indicator, such as a pop-up column pressure indicator 48, to indicate to the operator the presence of sufficient operating pressure in the system. A flexible pressure hose 50 interconnects the portion of the pneumatic circuit 52 of system 20 supported by column 24 to the portion of the pneumatic system supported by arm assembly 26. The flexible nature of hose 50 facilitates the adjustability of arm assembly 26 along column 24.

Figure 5:
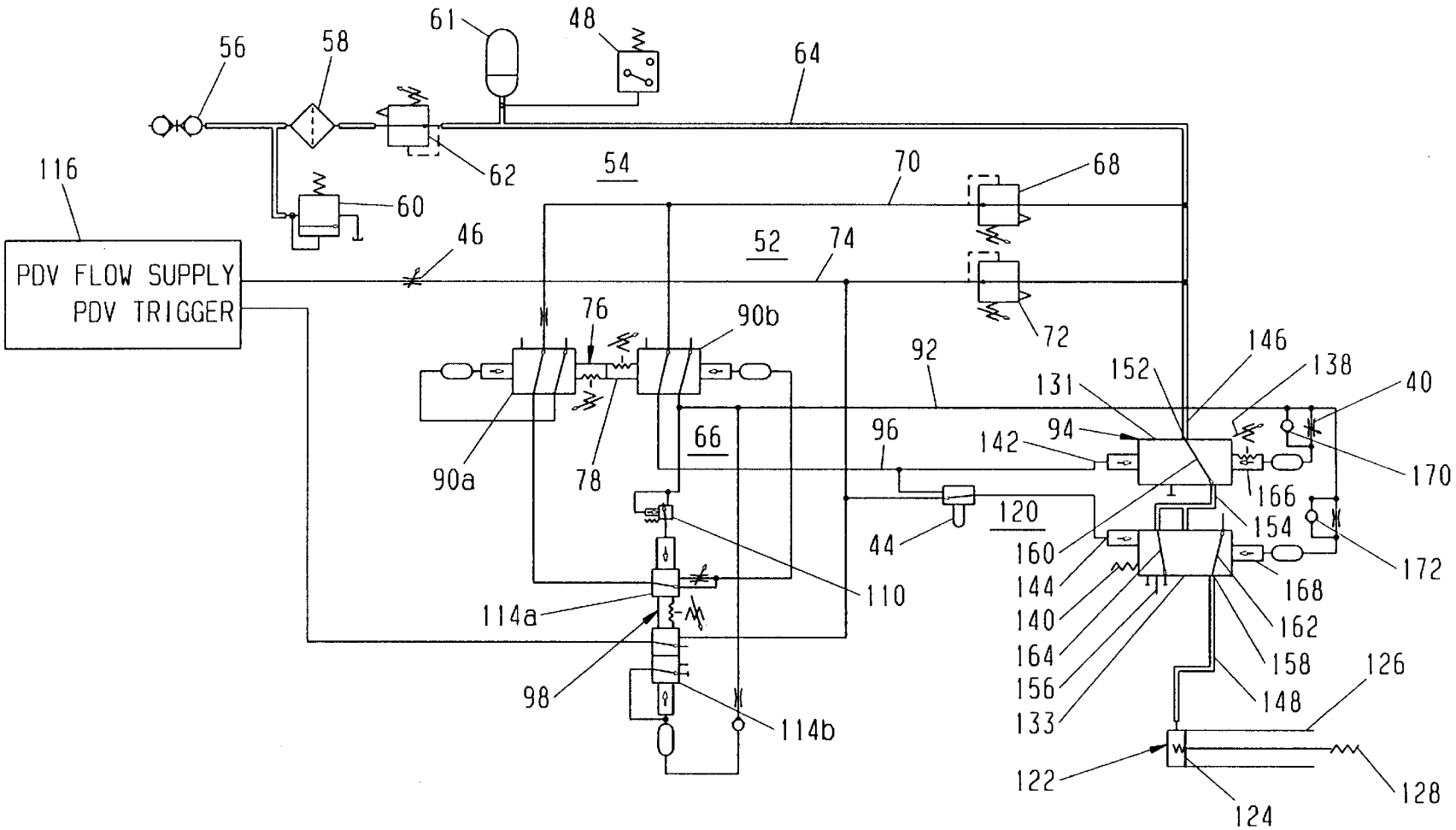
FIG. 5 is a schematic diagram of a pneumatic control system of the apparatus in FIG. 1.

CPR system 20 includes a fluid-based control system 52 (FIG. 5). As previously set forth, fluid control system 52 is preferably operative operated by oxygen, but could, alternatively, be operated by some other gas or non-gas fluid. Control system 52 includes a supply system 54 made up of a quick connect connector 56 for coupling with a source of oxygen or other fluid, such as through hose 34, and a filter 58 to remove dust and other particles from the control fluid. A pressure release valve 60 is provided to limit over pressure conditions from damaging system components.

Figure 9:
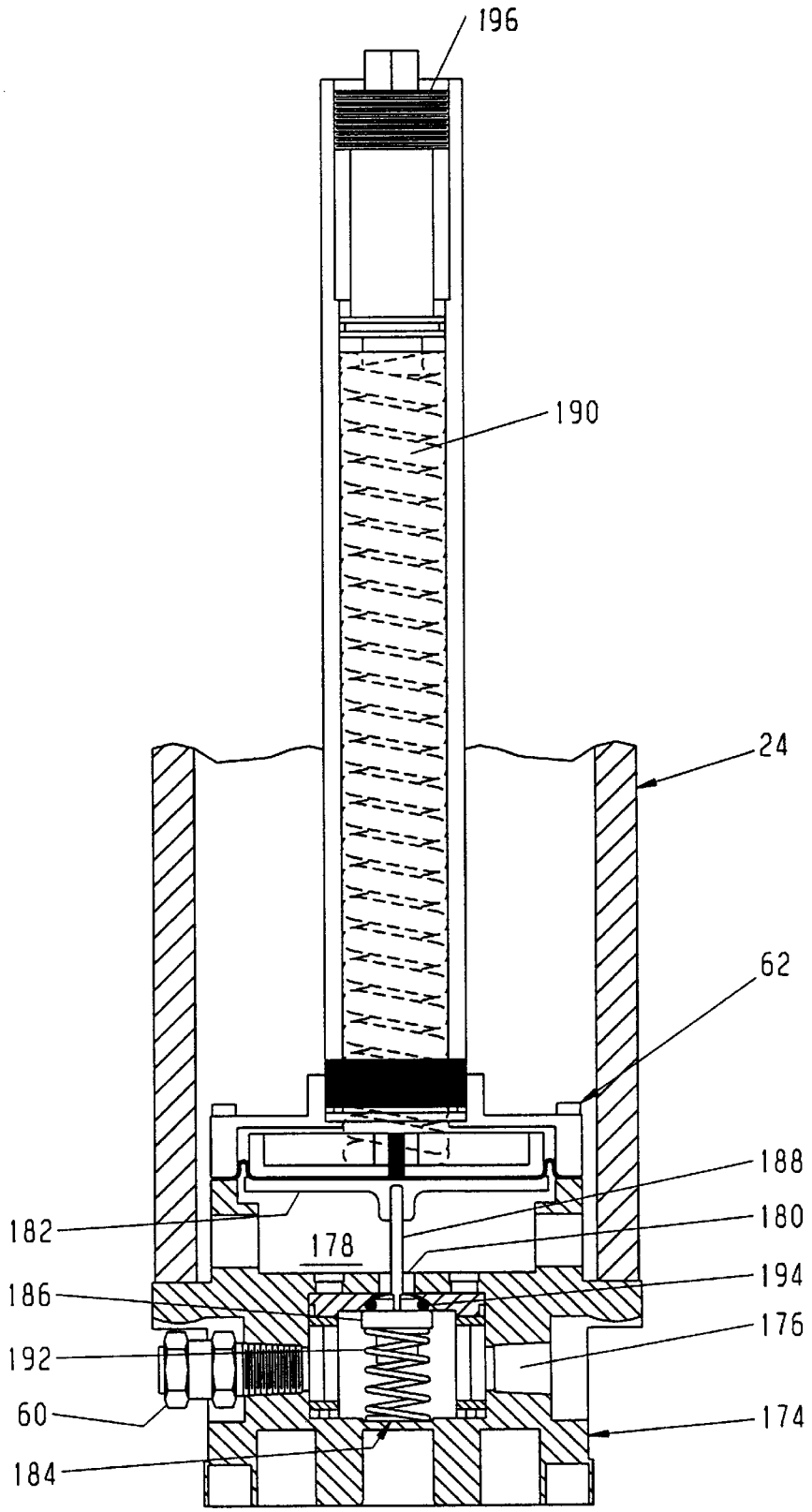
FIG. 9 is a sectional view of a system pressure regulator.

A system pressure regulator 62 produces a high flow rate of fluid at a controlled pressure. Preferably, system pressure regulator 62 regulates pressure from an unregulated pressure source to a regulated pressure that is greater than or equal to one-half of the source pressure level that is relatively close to supply pressure. System pressure regulator 62 includes a base 174 defining an inlet chamber 176 which is connected with an outlet chamber 178 by a control passage 180 (FIG. 9). A control valve 184 is positioned to regulate the flow through control passage 180. Control valve 184 includes a poppet 186 which selectively closes control passage 180. Poppet 186 is moved away from control passage 180 by a sensing diaphragm 182 which is connected with poppet 186 by a stem 188. Stem 188, in the illustrated embodiment, is hollow to thereby transmit the pressure of inlet chamber 176 to sensing diaphragm 182. A compression spring 190 biases sensing diaphragm 182 toward the open position of control valve 184 such that an increase in pressure in inlet chamber 176 causes sensing diaphragm 182 to tend to compress spring 190 causing poppet 186 to seal control passage 180. As pressure decreases in inlet chamber 176, the decrease in pressure in stem 188 allows the bias of spring 190 to flex diaphragm 182 thereby causing poppet 186 to be removed from control passage 180. Poppet 186 is biased in the direction of diaphragm 182 by a bias spring 192 and includes an O-ring 194 made from an oxygen compatible material, such as Viton, which seals the interface between poppet 186 and control passage 180. Spring 190 is of a length that it is compressed a small percentage of its length during normal operation of pressure regulator 62. Spring 190 is, therefore, operated in a linear region of the spring-force curve. A compression adjustment device, such as screw 196, allows the pre-tension of spring 190 to be adjusted. This adjusts the operating point of control valve 184 thereby allowing the output pressure of system regulator 62 to be adjusted. Pressure relief valve 60 is mounted to base 174 in fluid connection with inlet chamber 176. In the illustrated embodiment, system regulator 62 is positioned with column 24. This is advantageous because it conveniently accommodates the length of spring 190 and combines a housing for system regulator 62, the function of buffer column, and the support of arm assembly 26 in one convenient assembly.

In operation, system regulator 62 repeatedly opens and closes control valve 184 as a function of inlet pressure as sensed by diaphragm 182. The duty cycle between opening and closing of control valve 184 causes an adjustment of the pressure in outlet chamber 178. The configuration of system regulator 62 allows a sufficiently regulated outlet pressure at a level that is within one order-of-magnitude of the inlet pressure level at a relatively high flow rate. By way of example, in the illustrated embodiment, pressure regulator 62 produces a nominal output pressure of between 48 psig and 63 psig from an input pressure of between 50 psig and 90 psi at a flow rate of at least 100 liters per minute and, preferably, at least 125 liters per minute. System pressure regulator 62 produces an output to a conduit 64 which is supplied to other portions of the fluid control system, as set forth below.

Figure 6:
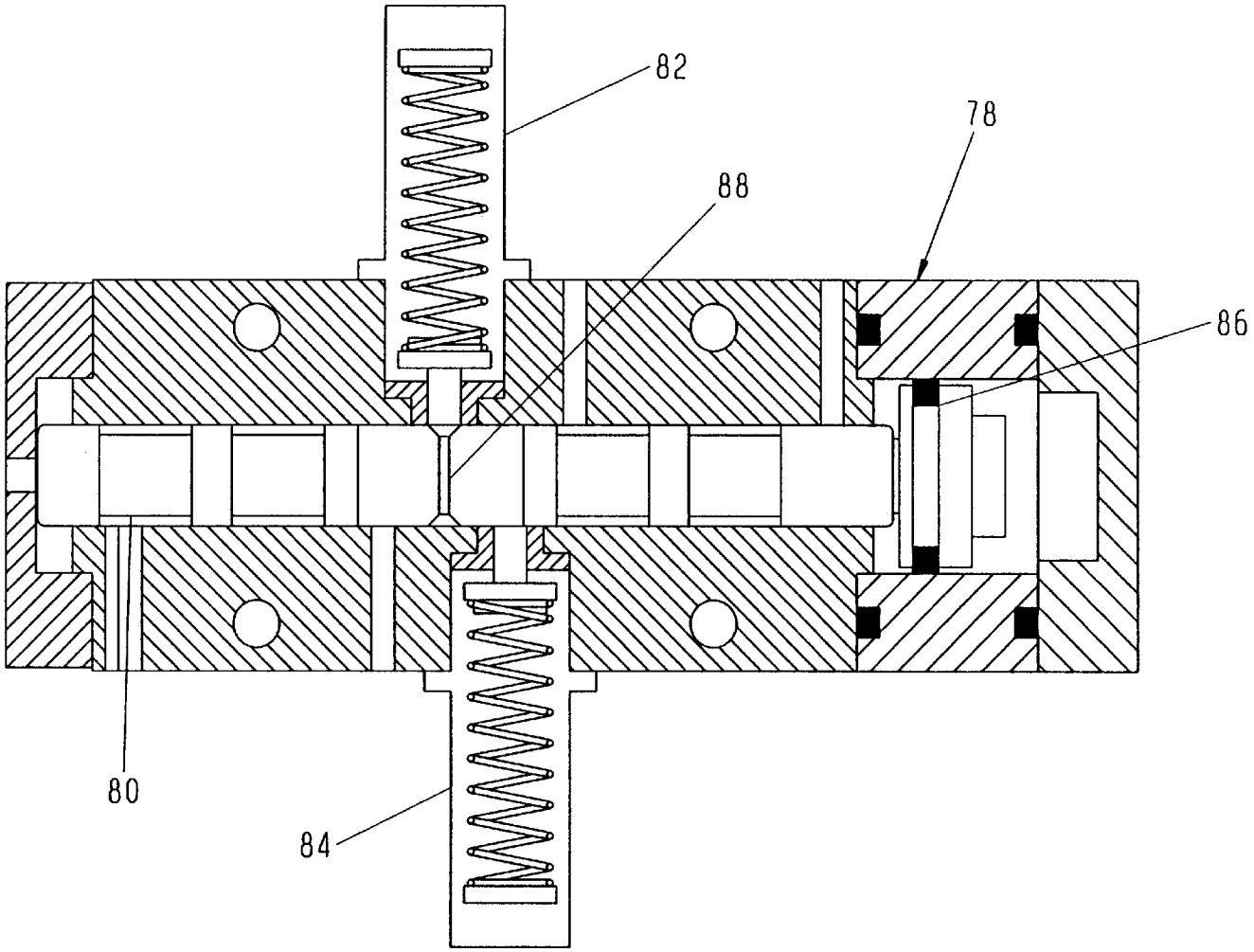
FIG. 6 is a sectional view of a precision timing valve assembly.

Fluid control system 52 additionally includes a timing circuit, such as timing and control section 66. Timing and control section 66 receives regulated pressure from a timing circuit regulator 68, which is supplied from conduit 64 and produces, in the illustrative embodiment, an output pressure of approximately 30 psig on line 70. Timing and control section 66 additionally includes a ventilation and control supply regulator 72, which is supplied from conduit 64 and produces an output, in the illustrative embodiment, of approximately 30 psig on an output line 74. Timing and control section 66 includes a pneumatic oscillator circuit 76, which is supplied from timing circuit regular 68 through a resistor R1 alternatingly to a pneumatic capacitor C1 and C2 in order to control, respectively, the diastolic and systolic phases of the compression cycle. Pneumatic capacitors C1 and C2 are connected to a timing valve assembly 78 (FIG. 6), which is made up of a spool 80 having two stable positions that are maintained by a pair of spring-biased detent assemblies 82 and 84. Capacitors C1 and C2 are connected to opposite sides of a piston 86 thereby allowing the spool 80 to be moved between the position illustrated in FIG. 6, in which detent assembly 82 is engaged with a recess 88, and a position in which spool 80 is moved to the right of the position illustrated in FIG. 6, in which detent assembly 84 engages recess 88. In the position illustrated in FIG. 5, compressed air is supplied through resistor R1 directly to capacitor C2 during the diastolic phase. Capacitor C2 and resistor R1 are sized in order to provide an approximately 375 millisecond time period for the diastolic phase cycle. At the end of the diastolic phase, the pressure developed in capacitor C2 is sufficient to move the spool 80 to the left from the position illustrated in FIG. 5 in order to begin the systolic phase.

When spool 80 is in the position opposite that as illustrated in FIG. 5, capacitor C2 is vented to atmosphere and valve portion 90*b* connects the pressure of line 70 to a line 92 connected with a chest compression cylinder control valve assembly 94 to initiate the systolic phase, or chest compression cycle, as will be described in more detail below. This also connects capacitor C1 through valve portion 90*a* to line 70 through resistor R1. This causes capacitor C1 to charge with pressure according to a time constant which regulates the systolic phase of the waveform which is nominally set to 375 milliseconds according to the American Heart Association protocol. At the end of the systolic phase, the pressure built up in capacitor C1 moves spool 80 to the position illustrated in FIG. 5 and the diastolic phase begins. To initiate the diastolic phase, a valve reset line 96 is pressurized by valve portion 90*b* to apply a pressure through stop input 44 to the valve reset ports 142 and 144 of valve 94, thus resetting the valve 94 in a reset state.

Figure 7:
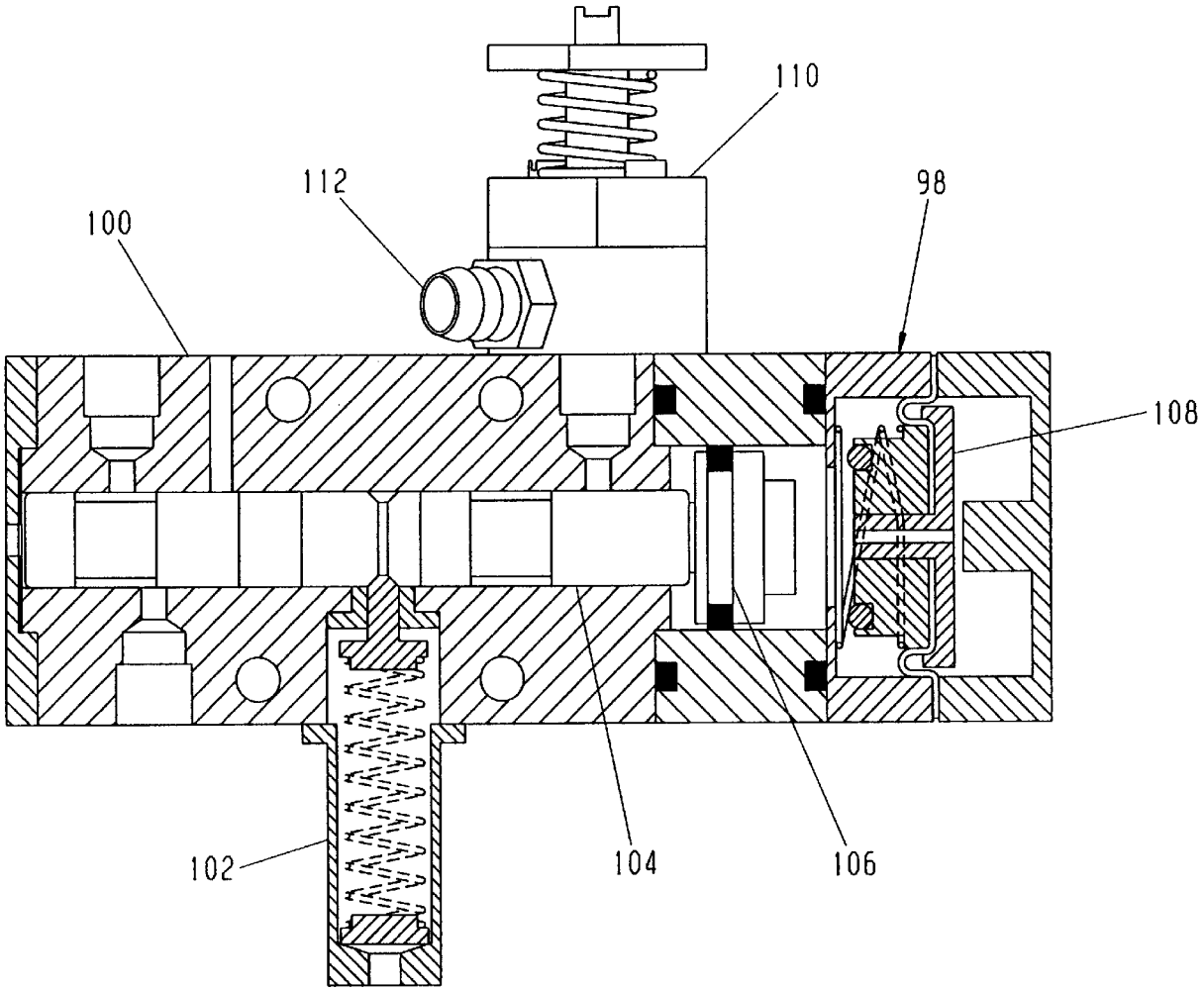
FIG. 7 is a sectional view of a variable oscillatory relay latched ordinate numeration valve assembly.

Timing and control section 66 additionally includes a cycle counter, such as a fluid-based cycle counting circuit 98, to control the relationship between chest compression cycles and ventilation cycles. Counting circuit 98 includes a valve assembly 100 (FIG. 7) and a pneumatic capacitor C3 which is charged through a pneumatic resistor R2. Valve assembly 100 includes a detent assembly 102, which provides a stable position for a spool 104, and a piston 106, which, when supplied with sufficient pressure from capacitor C3, moves spool 104 to the right, as illustrated in FIG. 7. A return spring assembly 108 returns spool 104 to the position illustrated in FIG. 7 when the pressure is vented from capacitor C3. Valve assembly 100 additionally includes a quick dump relay 110. Quick dump relay 110 includes a port 112 which is connected with valve portion 90*b* of timing valve assembly 78.

In operation, circuit 98 begins in the illustration illustrated in FIG. 5. A first valve portion 114*a* conducts the fluid from resistor R1 to pneumatic capacitor C2 bypassing a pneumatic resistor R3. A second valve portion 114*b* opens and closes the circuit between line 74 and patient demand valve device 116. Each time the timing circuit 76 goes through one cycle pressurizing line 92 during the systolic phase, a quantity of fluid is added to capacitor C3 through a resistor R2. Capacitor C3 and resistor R2 are sized in order to accumulate a quantity of fluid sufficient to create a number of cycles of circuit 76 equal to the ratio of chest compressions to ventilation cycles desired, as set forth by guidelines such as the American Heart Association protocol. When the number of chest compressions is sufficient to build a sufficient pressure in capacitor C3, piston 106 moves an actuating force for spool 104 within spool 104 to the state illustrated in FIG. 5. This connects patient demand valve 116 to supply line 74 through valve portion 114*b* in order to initiate a patient's ventilation cycle. Simultaneously, capacitor C3 is vented to atmosphere through valve portion 114*b* and valve portion 114*a* connects resistor R3 in the circuit leading to capacitor C2. Resistor R3 slows the charging of capacitor C2 thereby prolonging the diastolic cycle during which the patient is undergoing a ventilation cycle, which is in keeping with the American Heart Association protocol. Quick dump relay 110 ensures that circuit 98 will not move to a ventilation state during a systolic phase. During a systolic phase, the pressure in line 92 keeps circuit 98 in the state illustrated in FIG. 5. Once the pneumatic oscillating circuit 76 moves to the diastolic phase, pressure is relieved from quick dump relay 110 which allows the pressure therein to quickly dump to atmosphere thereby allowing circuit 98 to rapidly move to a ventilation position opposite that shown in FIG. 5.

Patient demand valve 116 is commercially available as marketed by Allied Health Care under Model No. L535-011. Patient demand valve 116 is supplied with ventilation oxygen through a ventilation flow rate control needle valve; namely, ventilator volume input 46. Resistor R3 increases the length of the relaxation phase during which ventilation occurs in the illustrated embodiment from approximately 375 milliseconds to approximately 1.5 seconds.

In the illustrated embodiment, the fluid connections between the various components making up timing and control system 66 are formed as channels in a pneumatic logic block to which the various components are mounted. As is known in the art, such channels may be machined in the face of a block of material and isolated from each other and from atmosphere by gasket material placed between the channels and a cover placed over the channels and gasket material. Also, in the illustrated embodiment, one or more capacitors C1 through C5 are provided in whole or in part by cavities formed in a block, such as the logic block, preferably on a portion of the logic block opposite the portion forming the fluid connection channels.

Fluid control system 52 additionally includes a chest compression control assembly 120. Chest compression control valve assembly 120 includes a control valve assembly, such as chest compression cylinder valve assembly 94, and a controlled volume device 122 in the form of a piston 124 in a cylinder 126. Control volume device 122 additionally includes a return spring 128 in order to return piston 126 to its retracted or released position at the end of a compression, or systolic, phase. In the illustrated embodiment, spring 128 has a spring force of three pounds or greater. Piston 124 is connected through patient massage pad 36 by a connecting rod 130.

Figure 8:
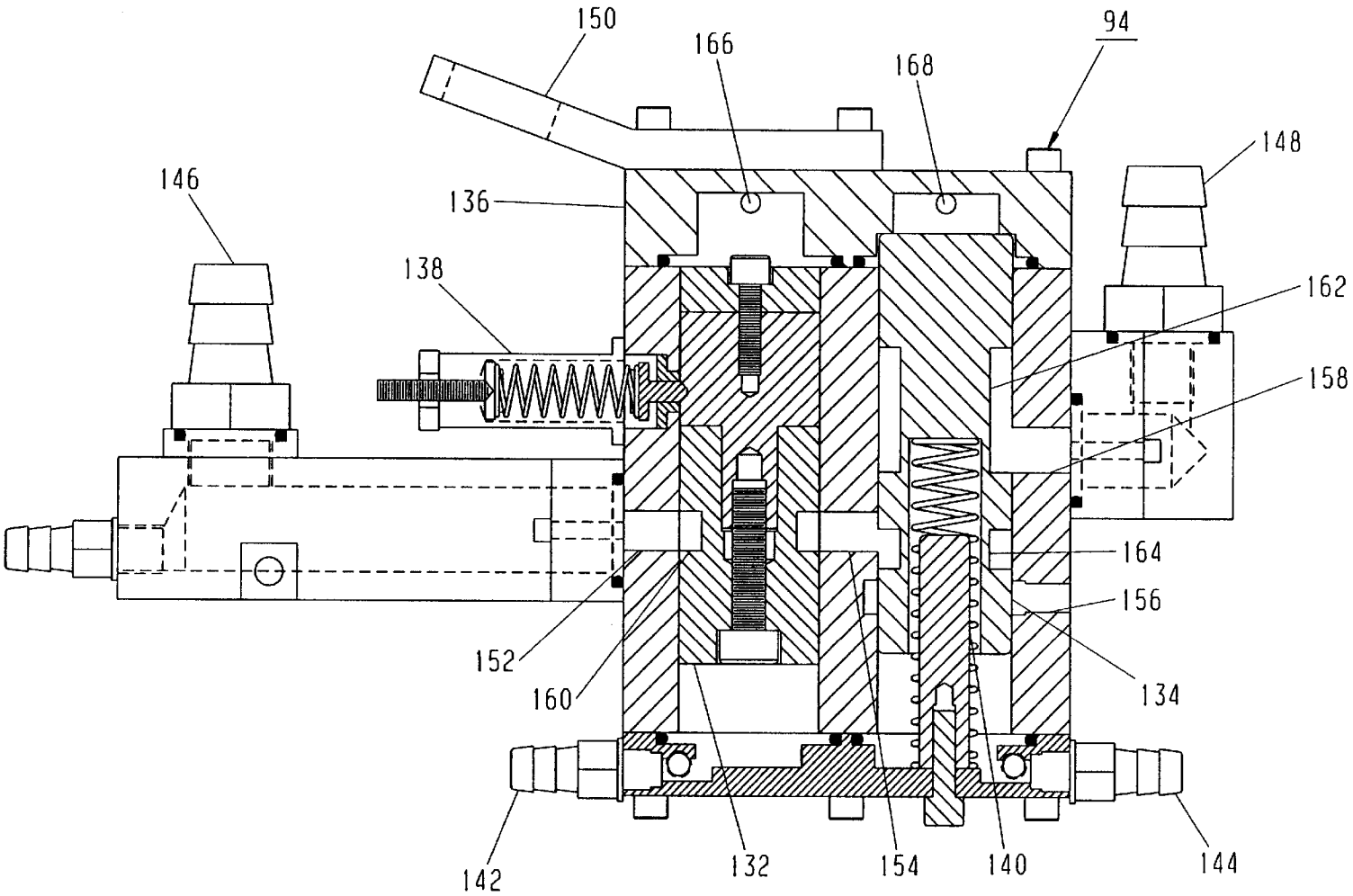
FIG. 8 is a sectional view of a chest compression cylinder control valve assembly.

Chest compression cycle control valve assembly 94 includes a first valve assembly 131, including a first spool 132, and a second valve assembly 133, including a second spool 134, both in a common housing 136 (FIG. 8). Valve assembly 94 includes a detent assembly 138 for use with first spool 132 and a return spring 140 for use with second spool 134. A port 142 which connects with line 94 provides a reset for valve 131. A port 144, which is connected with line 94 through run/stop input 44, provides a reset for valve assembly 133. An input port 146 is connected through conduit 64 to system pressure regulator 62, and an outlet port 148 is connected with control volume device 122. A bracket 150 on housing 136 provides a mount for patient demand valve 116. Valve assembly 131 has a passage 152 connected with input port 146 and a passage 154 connected with valve assembly 133. Valve assembly 133 has a vent passage 156 connected with atmosphere, a vent passage 157 connected with atmosphere and a passage 158 connected with output port 148. Valve assembly 131 has a channel 160 formed in spool 132. Valve assembly 133 has a first channel 162 and a second channel 164 formed in spool 134. When a particular channel is aligned with a pair of passages, it provides a path through the valve.

Chest compression control 120 additionally includes a capacitor C4 connected with a control port 166 of valve assembly 132 and a capacitor C5 connected with a control port 68 of valve assembly 134. Capacitor C4 is connected through compression depth input control 40, which is a variable resistor, to line 92. Capacitor C5 is connected through a fixed resistor R5 to line 92. Check valve 170 is provided in parallel with depth control resistor 40. Check valve 172 is provided in parallel with resistor R5.

When the timing and control system 66 pressurizes line 92 at the beginning of the systolic phase, capacitors C4 and C5 begin to fill. If the user adjusts depth input control 40 to a zero compression setting, which corresponds to a minimum restriction condition, capacitor C4 charges faster than capacitor C5 causing valve 131 to set sooner than valve 133. If the user sets depth input control 40 to a defined extent of compression, which corresponds to a more restricted condition, capacitor C5 charges faster than capacitor C4 causing valve 133 to set before valve 131 sets. At the end of the systolic phase and at the beginning of the diastolic phase, timing and control system 66 vents line 92 and pressurizes line 94. This causes capacitors C4 and C5 to rapidly depressurize through respective check valves 170, 172 and resets valves 132 and 134 to the position illustrated in FIG. 8 through reset ports 142 and 144, respectively. If run/stop switch 44 is placed in a "stop" position, valve 133 is held in a reset position by a continuous pressure from line 74.

Figure 10:
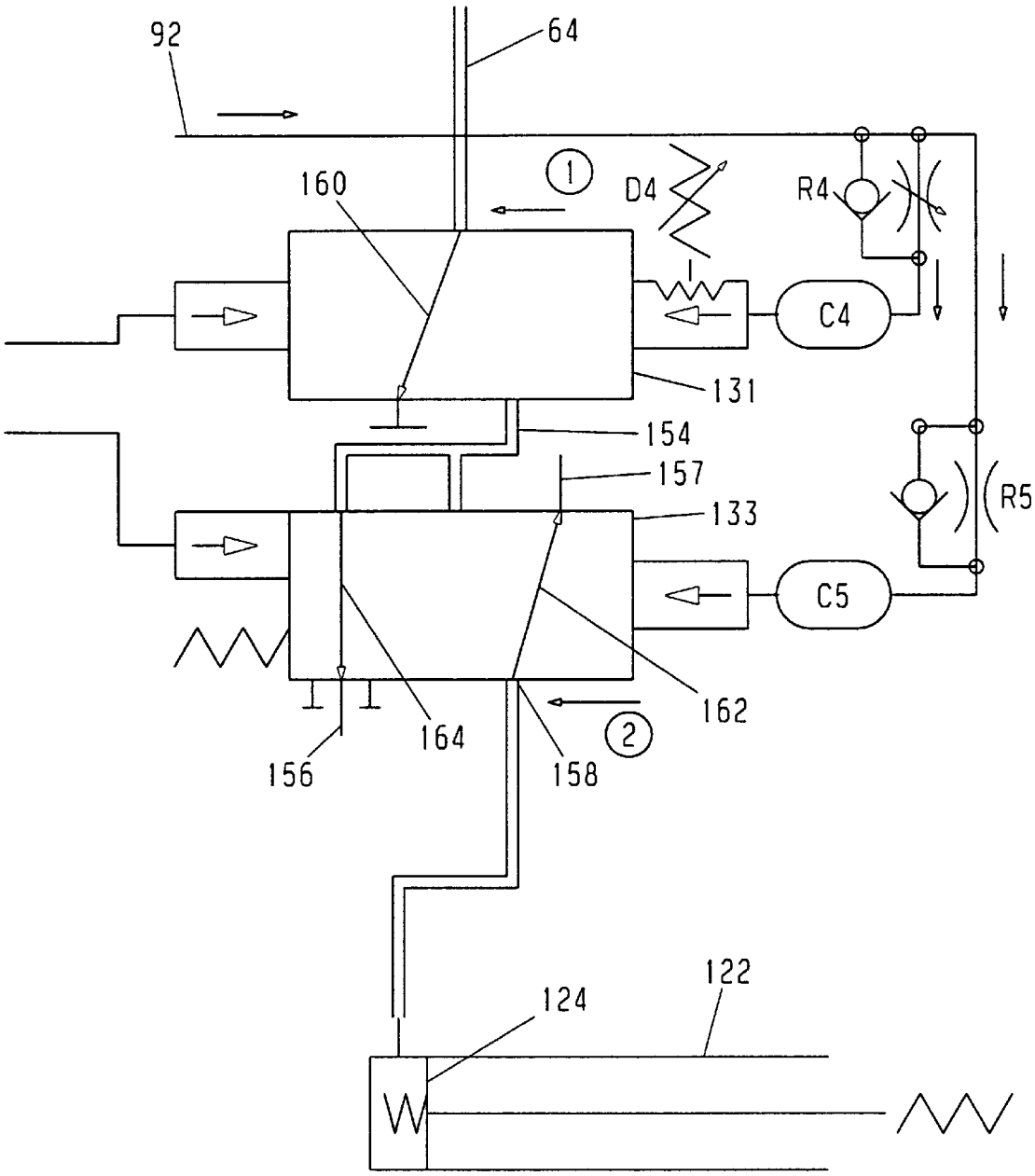
FIG. 10 is a diagram illustrating the chest compression cylinder control valve assembly during a systolic phase for which no compression has been selected.
Figure 11:
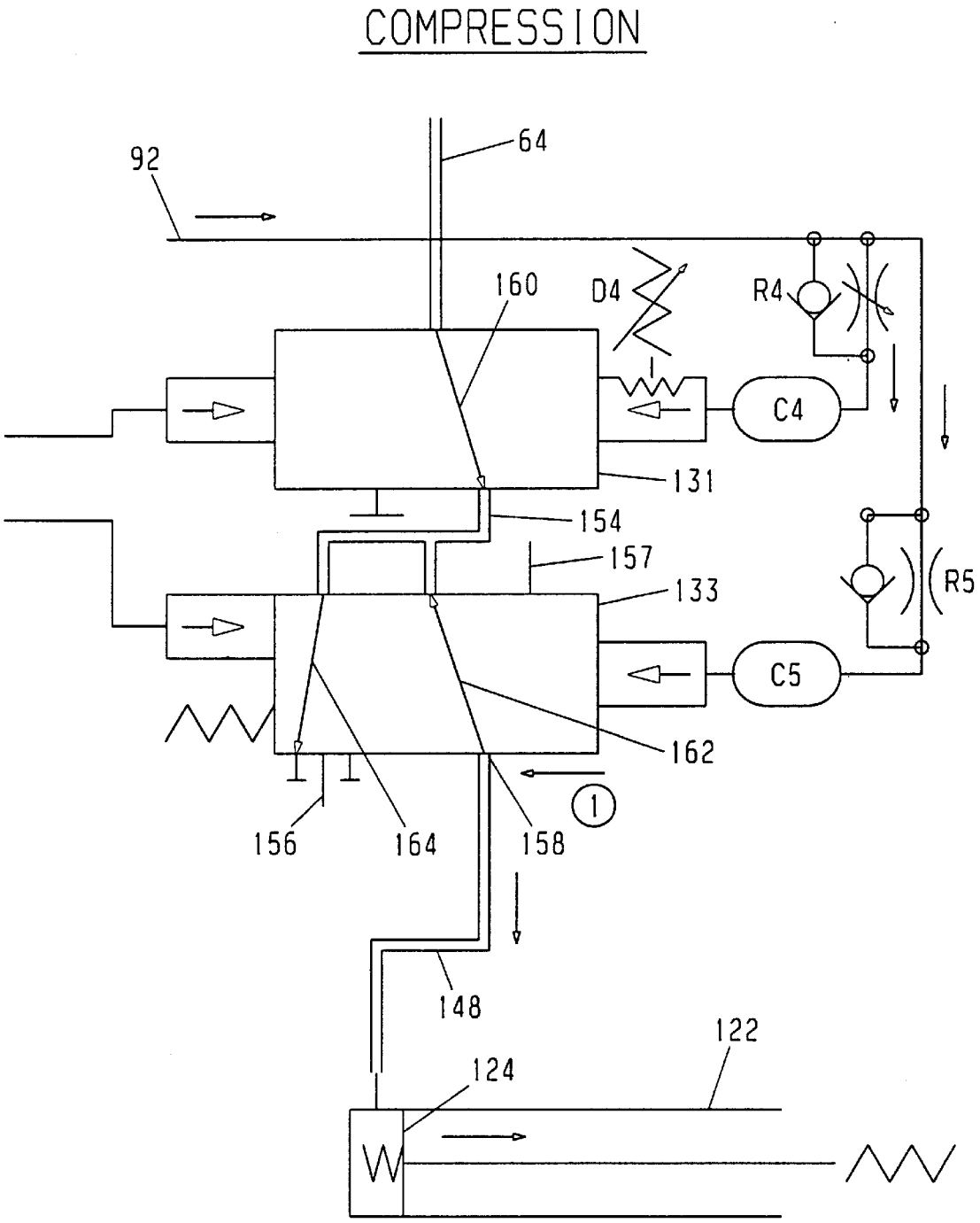
FIG. 11 is the same view as FIG. 10 during the acceleration portion of the systolic phase.
Figure 12:
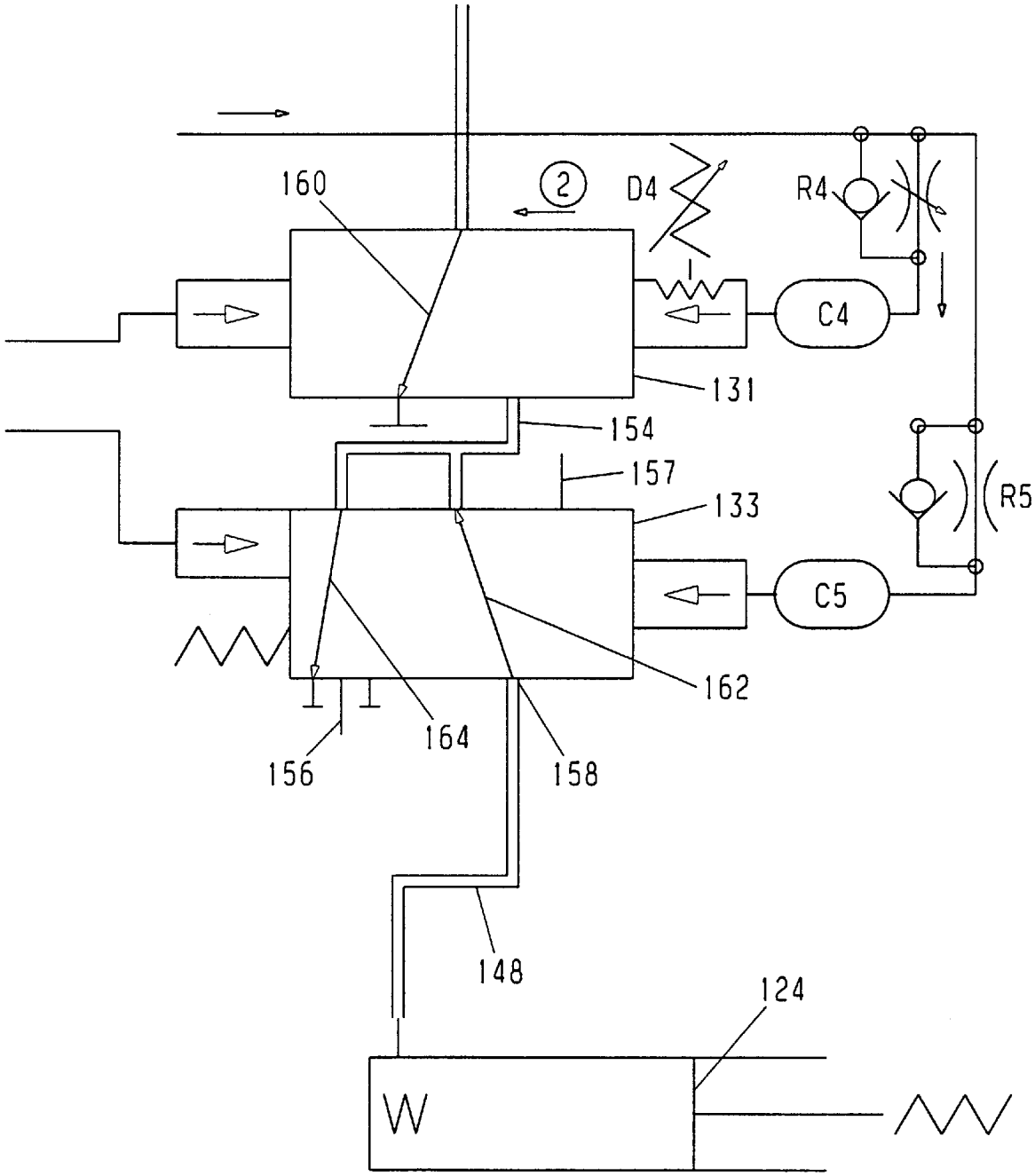
FIG. 12 is the same view as FIG. 10 during the holding portion of the systolic phase.

Operation of chest compression control system 120 can best be understood by reference to FIGS. 10–12. FIG. 10 illustrates the condition wherein the user adjusts compression input device 40 to a zero compression setting. In such setting, it is important that there be no perceivable movement in pressure pad 36. In such setting, the relative lack of restriction by compression input device 40 causes capacitor C4 to set valve 131 before capacitor C5 sets valve 133. When valve 131 is set, channel 160 switches to a blocked state, thus preventing system pressure regulator 62 from being connected with control volume device 22. When capacitor C5 causes valve 133 to set after valve 131 has set, channel 164 is momentarily connected with vent passage 156, thereby venting any pressure buildup in Turbin valve 94. In this manner, when channel 162 interconnects passage 154 and passage 158 upon the subsequent setting of valve 133, there will be no pressure charge that can perceivably move pressure pad 36. At the end of the systolic phase, valves 131 and 133 are reset without any substantial compression stroke occurring.

Figure 13:
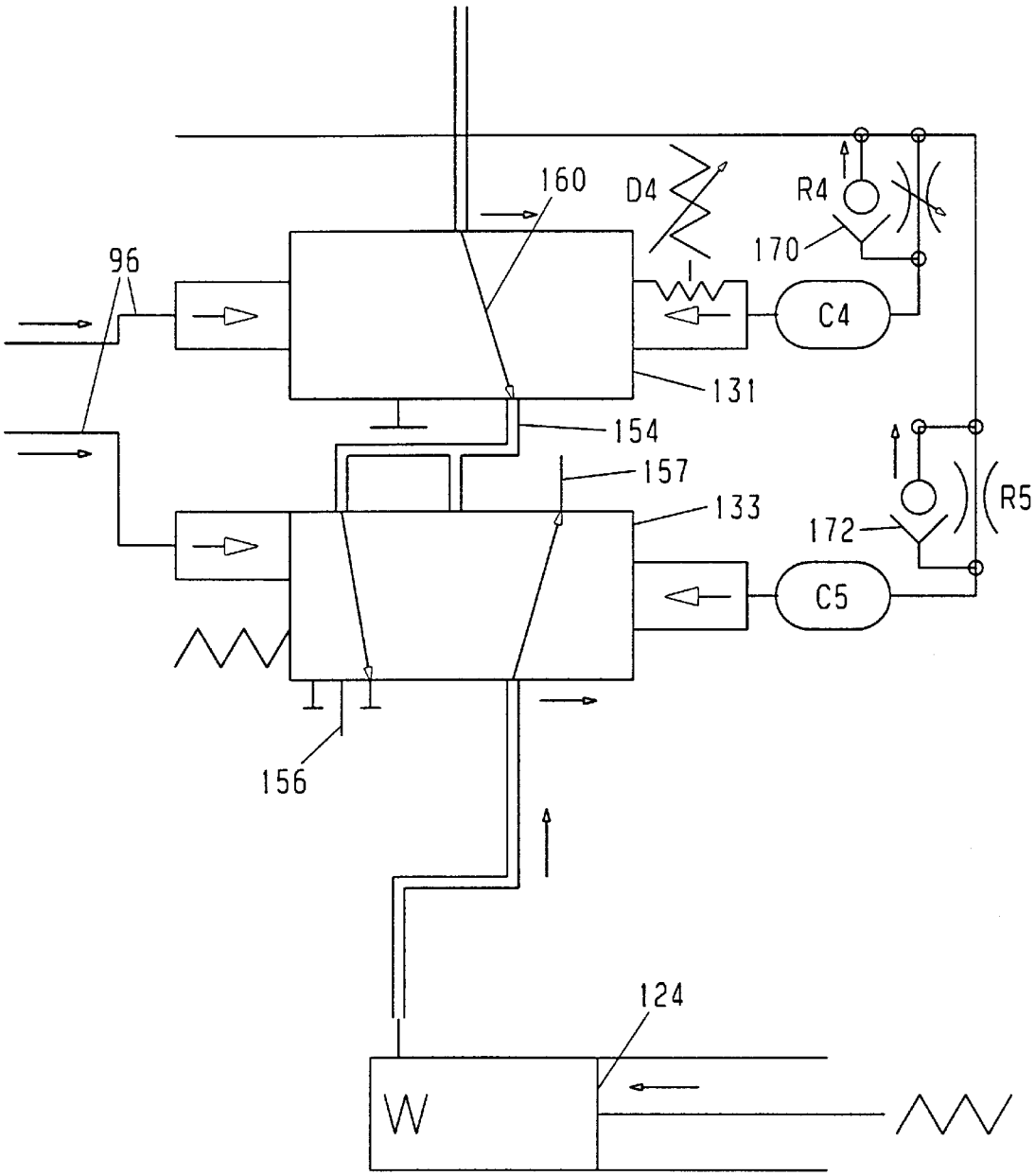
FIG. 13 is the same view as FIG. 10 during the initial portion of the diastolic phase.

In the second situation illustrated in FIGS. 111 and 12, the user has dialed in a compression on the compression depth input control 40. As previously set forth, such manipulation of input 40 causes an increase in the restriction thereof which causes capacitor C4 to charge slower than capacitor C5. This causes valve 133 to set prior to valve 131 setting. When valve 133 sets prior to valve 131 setting, channel 162 connects passage 154 with passage 158. Passage 154 is connected through channel 160 to the output of system regulator 62 causing the relatively high output volume of system regulator 62 to be applied to controlled volume device 122. This results in displacement of piston 124 for the duration of time that valve 133 is set and valve 131 is not yet set. When the capacitor C4 charge is sufficient to set valve 131 (FIG. 12), system pressure regulator 62 is disconnected from control volume device 122 eliminating any further fluid volume being added to control volume device 122. Valves 131 and 133 remain in such position until reset at the end of the systolic phase by line 94 being pressurized and line 92 being vented. During such period when valves 131 and 133 are set, valve 133 seals port 148 which causes the fluid supplied to control volume device 122 to remain sealed therein. This holds the compression stroke at its full extended position until valves 131 and 133 are reset (FIG. 13) at the end of the systolic phase by the pressure on line 96 and elimination of pressure on line 92.

Figure 14:
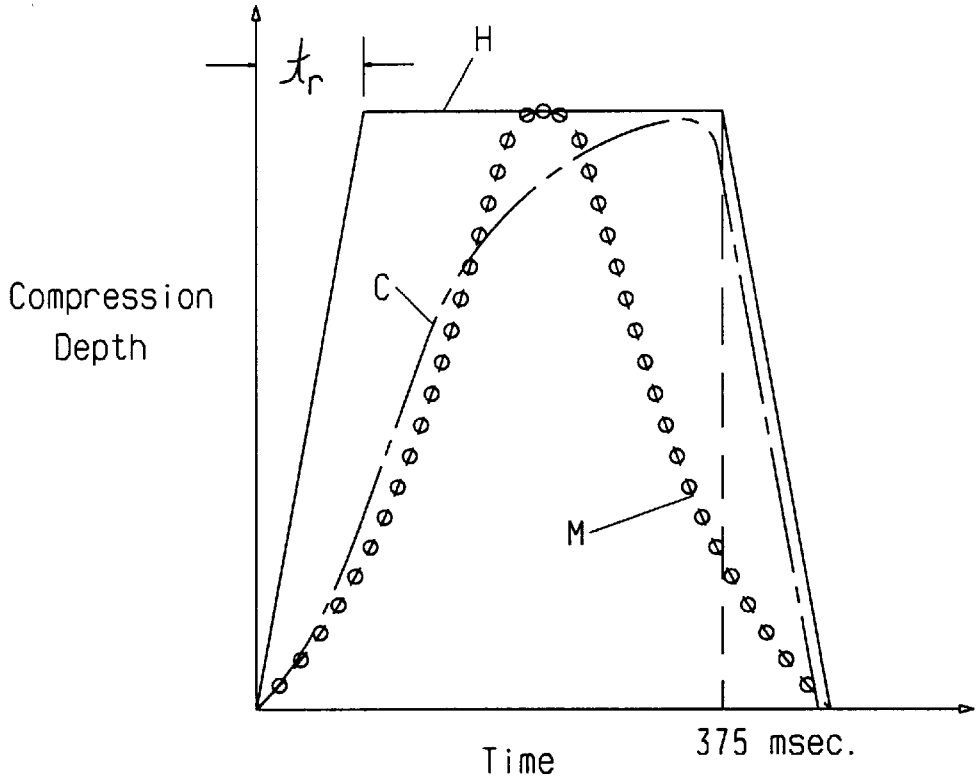
FIG. 14 is a diagram illustrating a comparison of the waveform produced by the apparatus in FIG. 1 with a waveform produced by prior methods.

A cardiopulmonary resuscitation system disclosed herein is capable of accelerating the patient's chest to a compression depth of at least 3 centimeters and, preferably, at least 8.5 centimeters in a rise time $T_r$ (FIG. 14) of less than 100 milliseconds and, preferably, less than 60 milliseconds and, most preferably, approximately 50 milliseconds. Furthermore, the CPR system is capable of maintaining that compression during the remaining portion of the compression phase and quickly releasing the compression thereby allowing the patient's chest to reshape without interference from the CPR system. Although the invention is illustrated with the piston being returned by a return spring, with minor modification to the fluid control system, it would be possible to actively return the piston using fluid pressure. It would also be possible to adjust the spring force of spring 128 to provide at least a greater amount of active return of the pressure pad.

Figure 15:
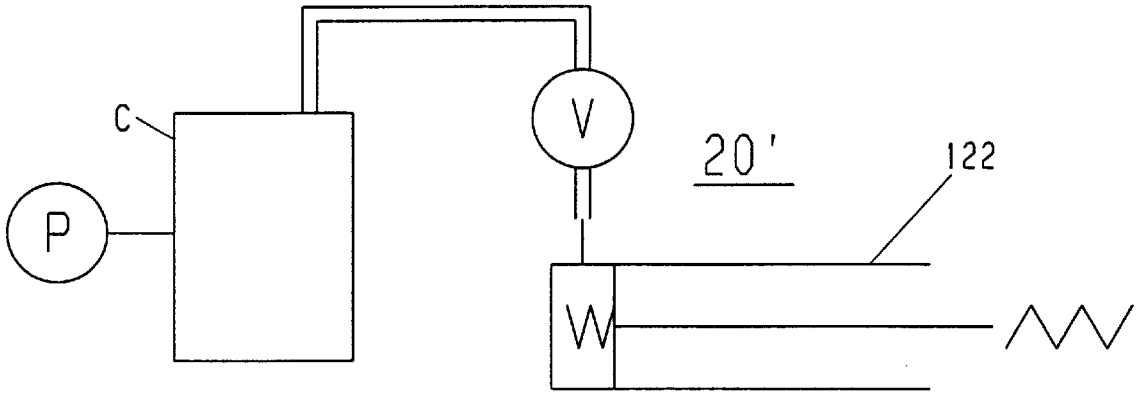
FIG. 15 is a block diagram of an alternative embodiment.

Alternative techniques are available for supplying a fixed quantity of a fluid to the controlled volume device. In a cardiopulmonary resuscitation system 20', illustrated in FIG. 15, a chamber C is provided separate from the controlled volume device 122 and pressurized to a particular pressure P during the relaxation phase by a pressure source (not shown). During the systolic phase, a valving arrangement V connects chamber C with controlled volume device 122. The gas in chamber C quickly equalizes in the controlled volume device providing a controlled quantity of fluid in the controlled volume device. While CPR system 20' would be fully functional, it would require a chamber C having a volume that is quite large with respect to the overall size of the cardiopulmonary resuscitation system 20'.

Although the controlled volume device is illustrated as a piston operating in a cylinder, other controlled volume devices could be used, such as bladder-type devices, bellows, gas bags, and the like. Other devices could be used with cardiopulmonary resuscitation system 20, 20', such as ECG parameter monitoring devices of the type disclosed in commonly assigned U.S. Pat. Nos. 5,077,667 and 5,683,424, the disclosures of which are hereby incorporated herein by reference, as well as automatic fibrillator devices, and the like. As previously set forth, the invention could be utilized to perform cardiopulmonary resuscitation with active reshaping of the chest as disclosed in commonly assigned U.S. Pat. No. 5,743,864, the disclosure of which is hereby incorporated herein by reference. Additionally, although the invention is illustrated as an entirely fluid-based system, particular functions could be alternatively carried out by electrical or electronic control systems.

Changes and modifications in the specifically described embodiments can be carried out without departing from the principles of the invention, which is intended to be limited only by the scope of the appended claims.

The embodiments of the invention in which an exclusive property or privilege is claimed are defined as follows:

1. A method of performing high impulse cardiopulmonary resuscitation, comprising:

providing a chamber having an expandable volume and a patient-contacting pad that moves as a function of volume of the chamber;

positioning said chamber with respect to the patient to bring said patient-contacting pad to alignment with the patient's chest; and supplying a controlled quantity of fluid to said chamber during a systolic phase in order to increase said chamber volume by a controlled amount wherein the patient-contacting pad is extended to a compression depth during a rise period and maintained substantially at the compression depth for a hold period that is greater than or equal to said rise period.

2. The method of performing cardiopulmonary resuscitation in claim 1 including supplying a controlled quantity of fluid by supplying fluid at a generally regulated pressure for a controlled time period.

3. The method of performing cardiopulmonary resuscitation in claim 2 including regulating pressure from an unregulated source pressure to a regulated pressure that is greater than or equal to half of the source pressure.

4. The method of performing cardiopulmonary resuscitation in claim 1 including moving said pad a compression depth of at least 3 centimeters during a rise period that is less than 100 milliseconds against the resistance of a patient.

5. The method of performing cardiopulmonary resuscitation in claim 4 including moving said pad said compression depth during a rise period that is less than 60 milliseconds.

6. The method of performing cardiopulmonary resuscitation in claim 5 including moving said pad said compression depth during a rise period that is approximately 50 milliseconds.

7. The method of performing cardiopulmonary resuscitation in claim 1 including moving said pad a compression depth of approximately 5 centimeters during a rise period that is less than 100 milliseconds against the resistance of a patient.

8. The method of performing cardiopulmonary resuscitation in claim 1 wherein said chamber is a cylinder and said volume of said chamber is expandable by a piston in said chamber connected with said patient-contacting pad.

9. The method of performing cardiopulmonary resuscitation in claim 8 including providing a spring in said chamber to return said piston to a position whereby the patient's chest is returned to an uncompressed state in a diastolic phase.

10. The method of performing cardiopulmonary resuscitation in claim 1 wherein said fluid is a gas.

11. The method of performing cardiopulmonary resuscitation in claim 10 wherein said gas is oxygen.

12. The method of performing cardiopulmonary resuscitation in claim 11 further including supplying oxygen to the patient during a ventilation phase between ones of said systolic phase.

13. The method of performing cardiopulmonary resuscitation in claim 1 wherein said supplying a controlled quantity of fluid includes adding the controlled quantity of fluid to the chamber at the beginning of the systolic phase and sealing said chamber to retain the controlled quantity of gas during the remainder of the systolic phase.

14. The method of performing cardiopulmonary resuscitation in claim 13 including providing at least first and second valves, said first and second valves operative to add said quantity of fluid to said chamber at the beginning of the systolic phase and said second valve operative to hold said quantity of fluid in said chamber during the remainder of said systolic phase.

15. The method of performing cardiopulmonary resuscitation in claim 14 wherein said second valve is operative to momentarily vent said first valve prior to connecting said first valve with said chamber at the beginning of the systolic phase.

16. The method of performing cardiopulmonary resuscitation in claim 14 wherein said second valve has an output port connected with said chamber and an input port connected with said first valve, said first valve has an output port connected with said second valve and an input port connected with a source of fluid.

17. A high impulse cardiopulmonary resuscitation apparatus, comprising:

a chamber having an expandable volume and a patient-contacting pad that moves as a function of volume of the chamber;

a frame including a first portion adapted to be positioned posteriorly of a patient and a second portion supporting said chamber; and a supply of a controlled quantity of fluid to said chamber during a systolic phase in order to increase said chamber volume by a controlled amount wherein said patient-contacting pad is extended to a compression depth during a rise period and maintained substantially at the compression depth for a hold period that is greater than or equal to said rise period.

18. The cardiopulmonary resuscitation apparatus in claim 17 wherein said supply supplies a controlled quantity of fluid by supplying fluid at a regulated pressure for a controlled time period.

19. The cardiopulmonary resuscitation apparatus in claim 18 wherein said supply includes a pressure regulator that regulates pressure from an unregulated source pressure to a regulated pressure that is greater than or equal to half of the source pressure.

20. The cardiopulmonary resuscitation apparatus in claim 19 including a pressure regulator positioned in a buffer tank, wherein said pressure regulator discharges regulated pressure at said buffer tank.

21. The cardiopulmonary resuscitation apparatus in claim 20 wherein said buffer tank defines said second portion of said frame.

22. The cardiopulmonary resuscitation apparatus in claim 17 wherein said pad moves a compression depth of at least 3 centimeters during a rise period that is less than 100 milliseconds against the resistance of a patient.

23. The cardiopulmonary resuscitation apparatus in claim 22 wherein said pad moves said compression depth during a rise period that is less than 60 milliseconds.

24. The cardiopulmonary resuscitation apparatus in clam 23 wherein said pad moves said distance during a rise period that is approximately 50 milliseconds.

25. The cardiopulmonary resuscitation apparatus in claim 17 wherein said pad moves a compression depth of approximately 5 centimeters during a rise period that is less than 100 milliseconds against the resistance of a patient.

26. The cardiopulmonary resuscitation apparatus in claim 17 wherein said chamber is a cylinder and including a piston that is adapted to expand said chamber volume, said piston connected with said patient-contacting pad.

27. The cardiopulmonary resuscitation apparatus in claim 26 including a spring in said chamber to return said piston to a position whereby the patient's chest is returned to an uncompressed state in a diastolic phase.

28. The cardiopulmonary resuscitation apparatus in claim 17 wherein said supply includes a valve assembly that adds a controlled quantity of fluid to the chamber at the beginning of the systolic phase and seals said chamber to retain the controlled quantity of gas during the remainder of the systolic phase.

29. The cardiopulmonary resuscitation apparatus in claim 28 wherein said valve assembly includes at least first and second valves, said first and second valves operative to supply said quantity of fluid to said chamber at the beginning of the systolic phase and said second valve operative to hold said quantity of fluid in said chamber during the remainder of the systolic phase.

30. The cardiopulmonary resuscitation apparatus in claim 29 wherein said second valve is operative to momentarily vent said first valve prior to connecting said first valve with said chamber at the beginning of the systolic phase.

31. The cardiopulmonary resuscitation apparatus in claim 29 wherein said second valve has an output port connected with said chamber and an input port connected with said first valve, said first valve has an output port connected with said second valve and an input port connected with a source of fluid.

32. The cardiopulmonary resuscitation apparatus in claim 35 wherein said control valve assembly includes at least first and second valves, said first and second valves operative to connect said pressure regulator output to said chamber during said period of time at the beginning of a systolic phase of said compression cycles and said second valve operative to seal said chamber during a remaining portion of said systolic phase.

33. The cardiopulmonary resuscitation apparatus in claim 32 wherein said first valve disconnects said pressure regulator from said chamber after said controlled period of time.

34. The cardiopulmonary resuscitation apparatus in claim 32 wherein said second valve is operative to momentarily vent said first valve to atmosphere prior to the beginning of said systolic phase.

35. A high impulse cardiopulmonary resuscitation apparatus, comprising:

a chamber and a piston in said chamber;

a frame including a first portion adapted to be positioned posteriorly of a patient and a second portion supporting the chamber;

a pressure regulator adapted to be supplied with a gas under pressure and producing a regulated pressure at an output of said pressure regulator;

a patient ventilator for applying ventilation to a patient;

a control valve assembly that is operative to selectively connect said pressure regulator output to said chamber to apply chest compressions to the patient; and a timing circuit to selectively operate said control valve assembly to supply regulated pressure from said output of said pressure regulator to said chamber to move said piston to a compression depth during a rise period and maintain said piston substantially at the compression depth for a hold period that is greater than or equal to said rise period to apply chest compression to a patient during a compression cycle and to selectively supply regulated pressure from said pressure regulator to said patient ventilator during a ventilation cycle.

36. The cardiopulmonary resuscitation apparatus in claim 35 wherein said timing circuit is supplied with regulated pressure from said pressure regulator output.

37. The cardiopulmonary resuscitation apparatus in claim 36 wherein said timing circuit includes an oscillator that alternates said control valve during said compression cycle between a systolic phase wherein said pressure regulator output is connected to said chamber and a diastolic phase wherein said pressure regulator output is not connected to said chamber.

38. The cardiopulmonary resuscitation apparatus in claim 37 wherein said timing circuit further includes a counter to count compression cycles and to cause said timing circuit to supply regulated pressure to said patient ventilator as a function of the number of said compression cycles.

39. The cardiopulmonary resuscitation apparatus in claim 38 wherein said counter comprises a valve and an actuator for said valve, said actuator responsive to fluid in a fluid reservoir, wherein said timing circuit applies a quantity of fluid to said fluid reservoir every one of said compression cycles and said actuator actuates said valve in response to an accumulation of fluid in said reservoir.

40. The cardiopulmonary resuscitation apparatus in claim 35 including a spring in said chamber to return said piston to a position whereby the patient's chest is returned to an uncompressed state in a diastolic phase.

41. The cardiopulmonary resuscitation apparatus in claim 40 wherein said control valve assembly includes first and second valves, said first and second valves operative to connect said chamber with the pressure source at the beginning of a systolic phase and said second valve operative to seal said chamber during the remaining portion of said systolic phase.

42. The cardiopulmonary resuscitation apparatus in claim 41 wherein said first valve disconnects said chamber from the pressure source after said period of time.

43. The cardiopulmonary resuscitation apparatus in claim 41 wherein said second valve is operative to momentarily vent said first valve to atmosphere prior to the beginning of a systolic phase.

44. The cardiopulmonary resuscitation apparatus in claim 35 including a pressure regulator positioned in a buffer tank, wherein said pressure regulator discharges regulated pressure at said buffer tank.

45. The cardiopulmonary resuscitation apparatus in claim 44 wherein said buffer tank defines said second portion of said frame.

46. A high impulse cardiopulmonary resuscitation apparatus operable from a pressure source, said apparatus comprising:

a chamber and a piston in said chamber;

a frame including a first portion adapted to be positioned posterior of a patient and a second portion supporting the chamber;

a control valve assembly operative to connect said chamber with a pressure source at the beginning of a systolic phase to admit a gas from the pressure source to move said piston toward a patient to initiate a chest compression and to disconnect said chamber from the pressure source and seal the gas in said chamber during the remaining portion of said systolic phase to hold the chest compression; and a timing circuit to selectively operate said control valve assembly.

47. The cardiopulmonary resuscitation apparatus in claim 46 wherein said timing circuit operates said control valve for a controllable time period.

48. The cardiopulmonary resuscitation apparatus in claim 47 wherein said timing circuit further includes a counter to count cycles of systolic phases and diastolic phases and to control a patient ventilator as a function of the number of said cycles.

49. The cardiopulmonary resuscitation apparatus in claim 48 wherein said counter comprises a valve and an actuator for said valve, said actuator including a fluid reservoir, wherein said timing circuit applies a quantity of fluid to said reservoir every one of said cycles and said actuator actuates said valve in response to an accumulation of fluid in said reservoir.

50. The cardiopulmonary resuscitation apparatus in claim 46 including a pressure regulator positioned in a buffer tank, wherein said pressure regulator discharges regulated pressure at said buffer tank.

51. The cardiopulmonary resuscitation apparatus in claim 50 wherein said buffer tank defines said second portion of said frame.

* * * * *